United States Patent [19]

Ryman, III

[11] Patent Number: 5,071,001

[45] Date of Patent: Dec. 10, 1991

[54] BEVERAGE CONTAINER STORAGE AND TRANSPORT APPARATUS

[76] Inventor: Raymond W. Ryman, III, Lot 102 Tuxedo, (TRPK), Rome, N.Y. 13440

[21] Appl. No.: 680,129

[22] Filed: Apr. 3, 1991

[51] Int. Cl.[5] ..... B65D 75/00; B65D 55/16; A47G 19/00

[52] U.S. Cl. ..... 206/139; 220/601; 220/627; 220/375; 220/94 B; 220/23.2; 206/504

[58] Field of Search ..... 206/139, 143, 504; 220/23.2, 601, 627, 375, 85 H, 94 B

[56] References Cited

U.S. PATENT DOCUMENTS 3,263,806 8/1966 Ring ..... 206/139 X
3,650,395 3/1972 Hobbs ..... 206/139
4,232,807 11/1980 Beier et al. ..... 206/139
4,986,431 1/1991 McCarter ..... 220/375 X

*Primary Examiner*—William I. Price
*Attorney, Agent, or Firm*—Leon Gilden

[57] ABSTRACT

An apparatus for the storage and transport of used and unused beverage containers is provided, wherein a matrix of tubular housings are arranged in a plurality of rows, including a central web directed orthogonally and medially of the tubes to secure the tubes together, with the web including a handle at a forwardmost end thereof. The web includes a rear projection, wherein the rear projection includes a plurality of tether lines, with the tether lines fixedly mounting lid members at equal spacings therealong for securement removably to upper terminal end portions of each tube. Lower portions of each tube include bottom lids, wherein the bottom lids are provided for containment of the beverage containers therewithin.

7 Claims, 4 Drawing Sheets

10
17a
21
22
11b
17
19
11b
11
11a
18
20
18a
11a
12
16
24
24
23

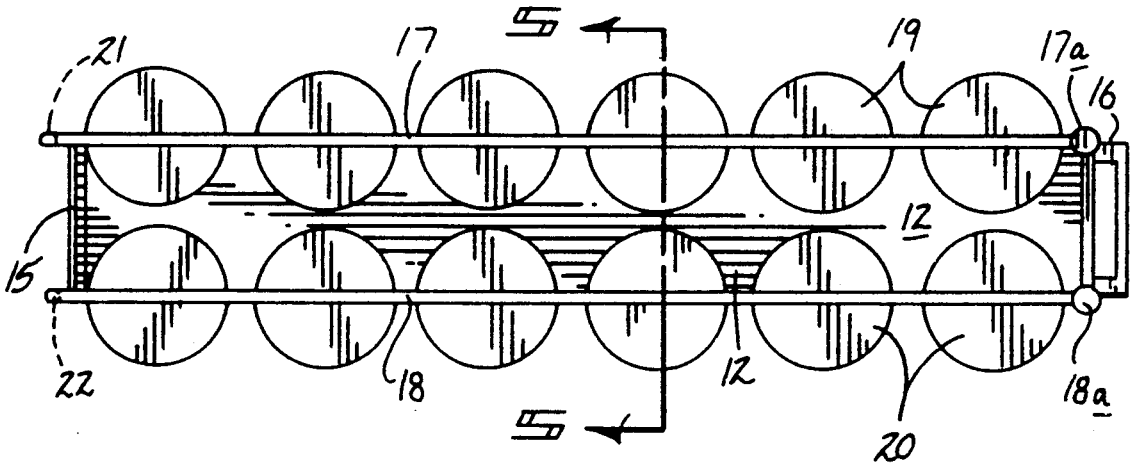
Fig 2
Fig 3
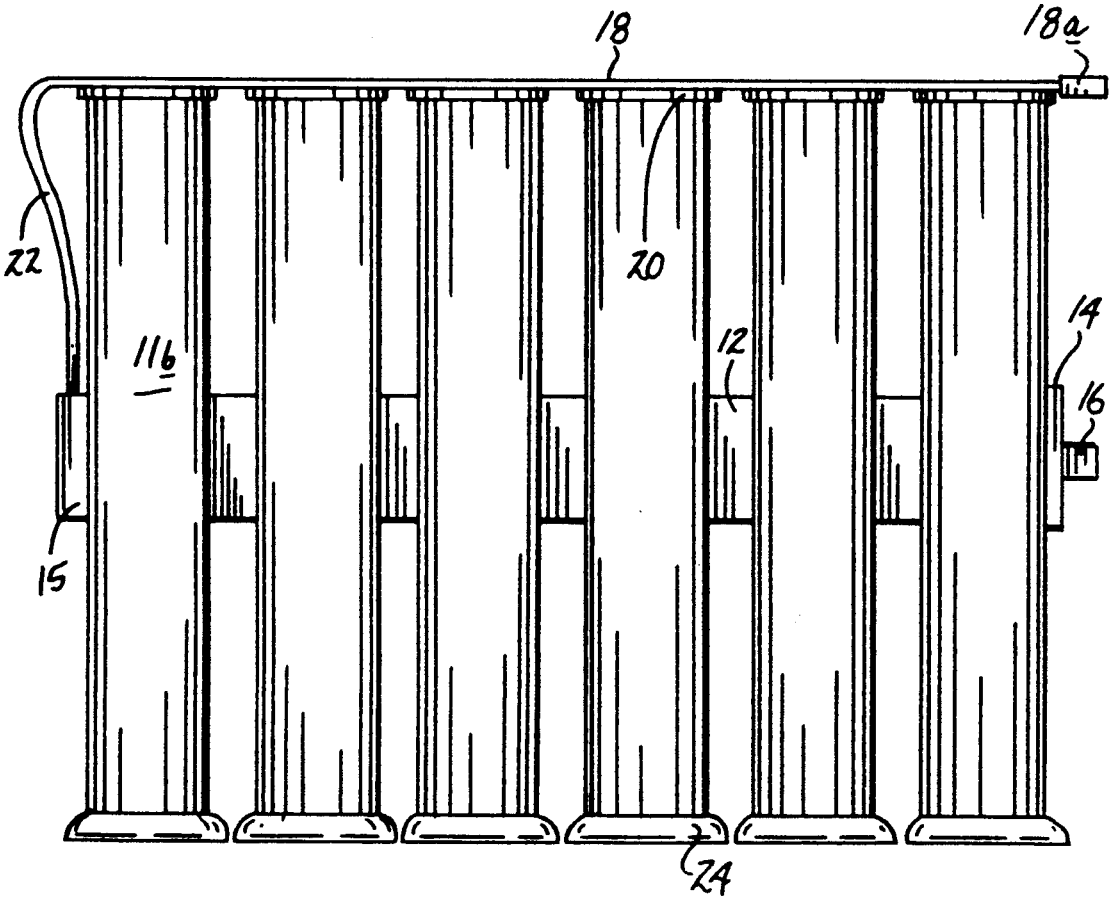

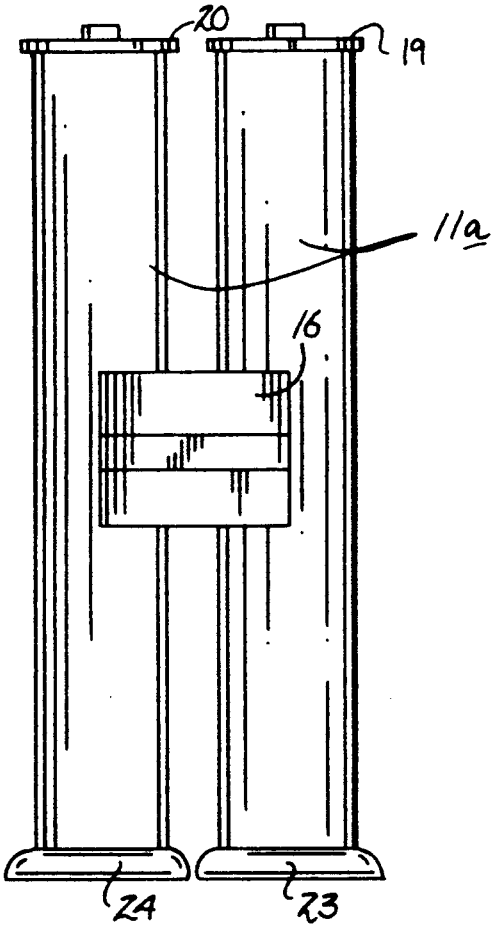
FIG 4
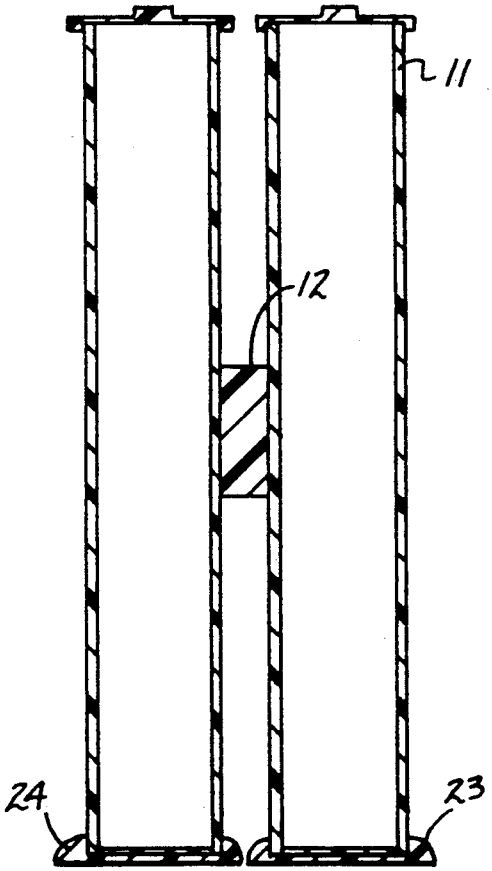
FIG 5
FIG 5A
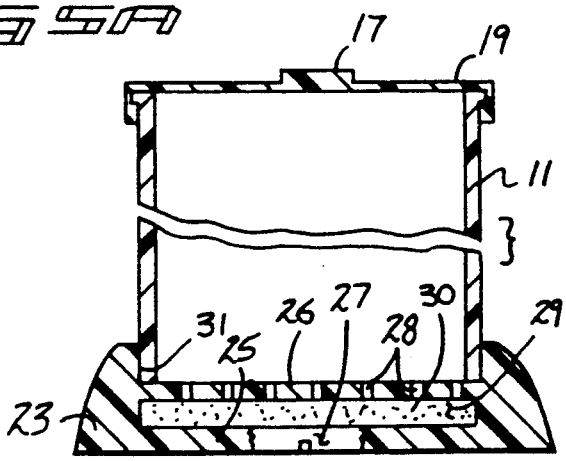

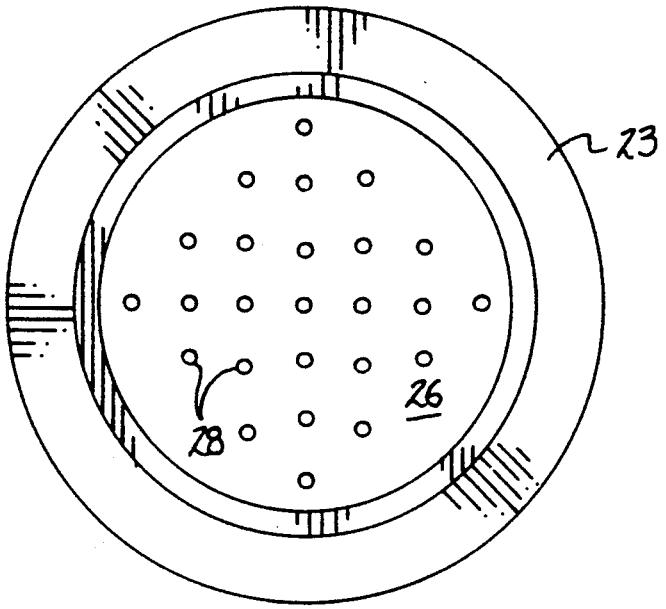
Fig 6
Fig 7
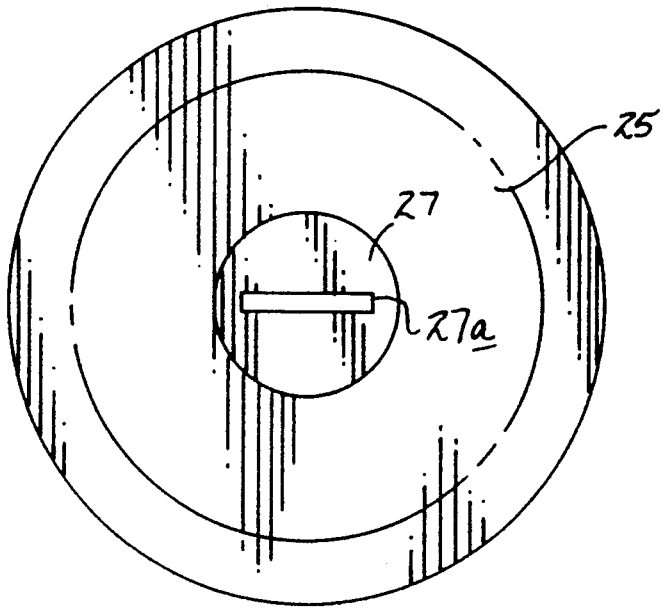

BEVERAGE CONTAINER STORAGE AND TRANSPORT APPARATUS

BACKGROUND OF THE INVENTION

1. Field of the Invention

The field of invention relates to beverage container storage apparatus, and more particularly pertains to a new and improved beverage container storage and transport apparatus wherein the same is arranged for the convenient storage and transport of various beverage containers prior to and subsequent their use.

2. Description of the Prior Art

Various holders and transport devices for beverage containers have been provided in the prior art. In use of such beverage containers subsequent to their consumption, they are frequently transported for recycling and the like. The instant invention sets forth an organization that is arranged to secure such beverage containers in column form permitting their sanitary and convenient transport to a recycling center as required. Examples of prior art storage container apparatus may be found for example in U.S. Pat. No. 3,893,615 to Johnson setting forth a multiple container structure for mounting flexible polymeric trash can liners therewithin.

U.S. Pat. No. 4,801,034 to Sandomeno sets forth a recycling bin wherein removable containers are mounted within each of a plurality of bin members.

U.S. Pat. No. 4,821,903 to Hayes sets forth a storage bin apparatus wherein a series of aligned bins utilize a single lid pivotally mounted overlying the bins.

U.S. Pat. No. 4,874,111 to Heller sets forth a multicompartment refuse container mounting flexible polymeric liners therewithin.

As such, it may be appreciated that there continues to be a need for a new and improved beverage container storage and transport apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of beverage container storage apparatus now present in the prior art, the present invention provides a beverage container storage and transport apparatus wherein the same is arranged for mounting and storage for subsequent transport of plural columns of beverage container. As such, the general purpose of the present invention, which will be described subsequently in greater detail, is to provide a new and improved beverage container storage and transport apparatus which has all the advantages of the prior art beverage container storage apparatus and none of the disadvantages.

To attain this, the present invention provides an apparatus for the storage and transport of used and unused beverage containers, wherein a matrix of tubular housings are arranged in a plurality of rows, including a central web directed orthogonally and medially of the tubes to secure the tubes together, with the web including a handle at a forwardmost end thereof. The web includes a rear projection, wherein the rear projection includes a plurality of tether lines, with the tether lines fixedly mounting lid members at equal spacings therealong for securement removably to upper terminal end portions of each tube. Lower portions of each tube include bottom lids, wherein the bottom lids are provided for containment of the beverage containers therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disolosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disolosure of the application. The abstract is neither intended to define the invention of the application, which is measured by the claims, nor is it intended to be limiting as to the scope of the invention in any way.

It is therefore an object of the present invention to provide a new and improved beverage container storage and transport apparatus which has all the advantages of the prior art beverage container storage apparatus and none of the disadvantages.

It is another object of the present invention to provide a new and improved beverage container storage and transport apparatus which may be easily and efficiently manufactured and marketed.

It is a further object of the present invention to provide a new and improved beverage container storage and transport apparatus which is of a durable and reliable construction.

An even further object of the present invention is to provide a new and improved beverage container storage and transport apparatus which is susceptible of a low cost of manufacture with regard to both materials and labor, and which accordingly is then susceptible of low prices of sale to the consuming public, thereby making such beverage container storage and transport apparatus economically available to the buying public.

Still yet another object of the present invention is to provide a new and improved beverage container storage and transport apparatus which provides in the apparatuses and methods of the prior art some of the advantages thereof, while simultaneously overcoming some of the disadvantages normally associated therewith.

Still another object of the present invention is to provide a new and improved beverage container storage and transport apparatus wherein the same further provides for lower chambers arranged adjacent lower terminal ends of each storage tube for containing a quantity of insecticide therewithin to minimize breeding of various undesirable pests attracted to syrup residue from the associated beverage containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top orthographic view of the instant invention.

FIG. 3 is an orthographic side view of the instant invention.

FIG. 4 is an orthographic frontal view of the instant invention.

FIG. 5 is an orthographic view, taken along the lines 5—5 of FIG. 2 in the direction indicated by the arrows.

FIG. 5*a* is an enlarged orthographic cross-sectional illustration of the top and bottom lids mounted to a single tubular member to exemplify their structural association with a tubular member.

FIG. 6 is an orthographic top view of the bottom lid utilized by the instant invention.

FIG. 7 is an orthographic bottom view of the bottom lid utilized by the instant invention.

DESCRIPTION OF THE PREFERRED EMBODIMENT

Figure 1:
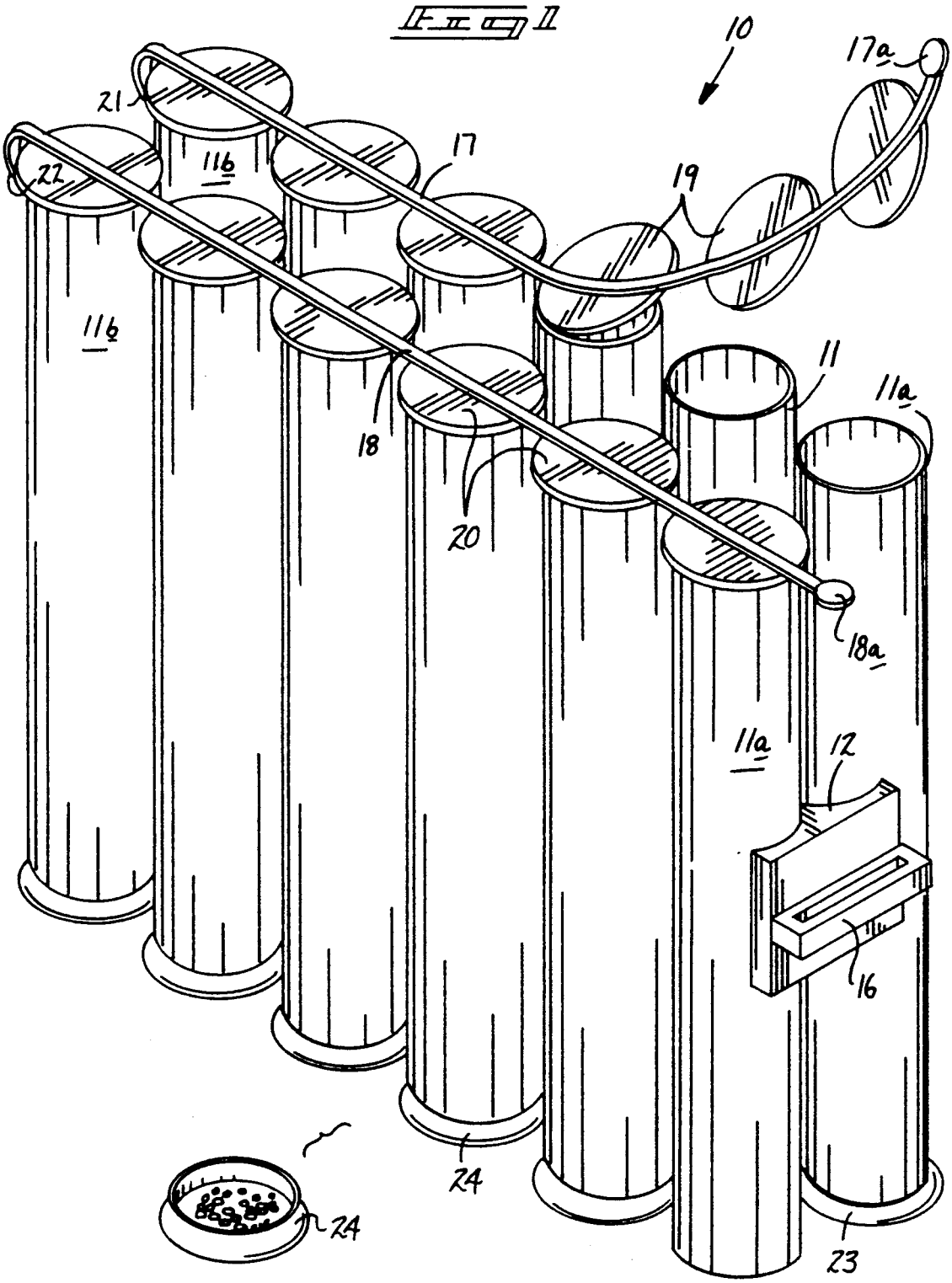
FIG. 1 is an isometric illustration of the instant invention.

With reference now to the drawings, and in particular to FIGS. 1 to 7 thereof, a new and improved beverage container storage and transport apparatus embodying the principles and concepts of the present invention and generally designated by the reference numeral 10 will be described.

More specifically, the beverage container storage and transport apparatus 10 of the instant invention essentially comprises a matrix of tubular members 11 arranged in a plurality of parallel rows, each tubular member 11 defined by a predetermined axial length defining right and left rows. Forwardmost tubes of the rows are defined as forward tubes 11*a*, with rearwardmost tubes defined as rearward tubes 11*b* defining forwardmost and rearwardmost tubes of each respective right and left row. A central connecting web 12 is fixedly and orthogonally mounted medially of the tubes and extends from the forwardmost tubes 11*a* through the rearwardmost tubes 11*b*. The central connecting web 12 includes a forward web projection 14 directed exteriorly and forwardly of the forwardmost tubes 11*a* mounting a handle 16 thereon. A rear web projection 15 is directed exteriorly of the rearwardmost tubes 11*b*. The rear web projection 15 mounts a respective right and left tether line rear anchor strap 21 and 22 and forming lower terminal ends of a respective right and left tether line 17 and 18. The right and left tether lines 17 and 18 extend overlying the respective right and left rows of the tubular members 11, wherein the right and left tether lines mount respective right and left top lid members 19 and 20 fixedly thereon, wherein the respective tether lines 17 and 18 are mounted to a top surface of each top lid member. The lid members 19 and 20 are fixedly mounted to the respective tether lines at a spacing substantially equal to axial spacings of each of the tubular members within a respective row. Further, each respective right and left tether lines 17 and 18 terminates in a right and left respective tether line extension 17*a* and 18*a* extending forwardly of a forwardmost lid to overlie a forwardmost tube 11*a* to enhance manual grasping of each respective tether line. In this manner, the lids are readily mounted and dismounted relative to the respective tubes.

Each tube further is formed with a bottom lid defining right and left bottom lids 23 and 24 securable to lower terminal ends of each of the tubular members 11. The bottom lids are each of identical construction and include a bottom lid lower floor web 25 (see FIGS. 5 and 5*a*) spaced below a bottom lid upper floor 26 defining an insecticide chamber 29 therebetween. The upper floor web 26 includes a plurality of apertures 28 directed therethrough extending in communication with the insecticide chamber 29 that receives a replenishable predetermined quantity of insecticide 30 therewithin. The insecticide 30 is replaced within the chamber 29 through a threadedly removable plug 27 threadedly mounted within the lower floor web 25. A slot 27*a* is formed within the plug 27 to permit ease of removal of the plug relative to the lower floor web 25. A cylindrical upper cavity wall 31 extends orthogonally and circumferentially about the upper floor web 26 to permit resilient securement of each lower terminal end of each tube member 11 therewithin, as the cylindrical cavity wall 31 is of a resilient construction to enhance engagement of each lower terminal end of each tubular member therewithin. In this manner, residue of each beverage container that may be mounted within each respective tubular member 11 will be directed downwardly onto the floor web 26, whereupon various crawling insects and the like that may enter each tubular member 11 will encounter the fluid mixed with the associated insecticide 30 to ensure extermination of such insects.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container storage and transport apparatus comprising, in combination, a matrix of tubular members, each tubular member defined by a predetermined length, and each tubular member coextensively arranged relative to an adjacent tubular member, and the matrix of tubular members defining a right and left row of tubular members, the right and left rows of tubular members including a plurality of forwardmost tubular members, and a plurality of rearwardmost tubular members, and a central connecting web orthogonally and integrally mounted to the right and left rows of tubular members, with the central connecting web extending forwardly of the forwardmost tubular members defining a forward web projection, and the central connecting web including a rear web projection extending exteriorly and rearwardly of the rearwardmost tubular members defining a rear web projection, and a handle mounted to the forward web projection, and the rear web projection including a right and left tether line mounted thereto, the right and left tether lines each including a plurality of respective right and left top lid members fixedly mounted thereto.

2. An apparatus as set forth in claim 1 wherein the right row of tubular members and the left row of tubular members define a predetermined number of tubular members, and the right lid members and the left top lid members including a plurality of lid members, each equal to the predetermined number, and the right row of tubular members spaced apart a predetermined axial spacing, and the left row of tubular members spaced apart the predetermined axial spacing, and the right and left top lid members spaced apart the predetermined axial spacing, and the right top lid members fixedly mounted to the right tether line, and the left top lid members fixedly mounted to the left tether line.

3. An apparatus as set forth in claim 2 wherein the right tether line includes a right tether line extension arranged for manual grasping, and the left tether line includes a left tether line extension arranged for manual grasping to enhance ease of removal and positioning of the respective right and left lid members on the respective right and left rows of tubular members.

4. An apparatus as set forth in claim 3 wherein each tubular member includes a removably mounted bottom lid.

5. An apparatus as set forth in claim 4 wherein each bottom lid includes a lower floor web and an upper floor web, wherein the upper floor web is spaced from the lower floor web to define an enclosed chamber, and the upper floor web includes a plurality of through-extending apertures directed through the upper floor web into the chamber, and the chamber includes an insecticide positioned therewithin.

6. An apparatus as set forth in claim 5 wherein the lower floor web includes a removably mounted plug member directed through the lower floor web to permit replenishment of the insecticide within the chamber.

7. An apparatus as set forth in claim 6 wherein the upper floor web includes a flexible cylindrical cavity wall oriented orthogonally and in surrounding relationship relative to the upper floor web to resiliently mount a respective bottom lid to a respective lower terminal end of each of said tubular members.

* * * * *